US011348536B2

(12) United States Patent
Wu et al.

(10) Patent No.: US 11,348,536 B2
(45) Date of Patent: May 31, 2022

(54) DETECTION CIRCUIT AND DRIVING METHOD THEREOF, AND DISPLAY PANEL

(71) Applicants: Hefei Xinsheng Optoelectronics Technology Co., Ltd., Hefei (CN); BOE TECHNOLOGY GROUP CO., LTD., Beijing (CN)

(72) Inventors: Jian Wu, Beijing (CN); Lei Guo, Beijing (CN); Guangyu Li, Beijing (CN); Yingya Zhou, Beijing (CN)

(73) Assignees: Hefei Xinsheng Optoelectronics Technology Co., Ltd., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/194,276

(22) Filed: Mar. 7, 2021

(65) Prior Publication Data

US 2022/0005418 A1 Jan. 6, 2022

(30) Foreign Application Priority Data

Jul. 6, 2020 (CN) ..... 202010642375.3

(51) Int. Cl.
*G09G 3/3275* (2016.01)
*G09G 3/00* (2006.01)

(52) U.S. Cl.
CPC ... *G09G 3/3275* (2013.01); *G09G 2300/0413* (2013.01)

(58) Field of Classification Search
CPC ..... G09G 3/3275; G09G 2300/0413; G09G 3/006
See application file for complete search history.

(56) References Cited

U.S. PATENT DOCUMENTS

2011/0210958 A1* 9/2011 Yoo ..... G09G 3/325 345/214
2012/0169704 A1* 7/2012 Chung ..... G09G 3/3233 345/212
2014/0354285 A1* 12/2014 Kim ..... G09G 3/3233 324/414
2015/0090961 A1* 4/2015 Lee ..... G09G 3/006 257/40
2015/0241501 A1* 8/2015 Jang ..... G09G 3/006 324/527

(Continued)

*Primary Examiner* — Ibrahim A Khan
(74) *Attorney, Agent, or Firm* — Thomas | Horstemeyer, LLP

(57) ABSTRACT

Provided is a detection circuit and a driving method thereof, and a display panel. The detection circuit includes: a plurality of first detection circuits, a plurality of second detection circuits, and a plurality of third detection circuits. The first detection circuit is connected to a first pin, a first control signal terminal, a first detection signal terminal, and a first gate line corresponding to the first detection circuit; the second detection circuit is connected to a second pin, a second control signal terminal, a second detection signal terminal, and a second gate line corresponding to the second detection circuit; the third detection circuit is connected to a first data line corresponding to the third detection circuit, a sensing signal line corresponding to the third detection circuit, a third detection signal terminal, and a third control signal terminal.

20 Claims, 2 Drawing Sheets

(56) References Cited

U.S. PATENT DOCUMENTS

| | | | | |
|---|---|---|---|---|
| 2015/0379908 | A1* | 12/2015 | Kim | G09G 3/006 345/84 |
| 2016/0148564 | A1* | 5/2016 | Kim | G09G 3/3233 345/211 |
| 2016/0155381 | A1* | 6/2016 | Kwon | G09G 3/3233 345/215 |
| 2016/0203760 | A1* | 7/2016 | Kwon | G09G 3/3233 345/214 |
| 2017/0032736 | A1* | 2/2017 | Gu | G09G 3/3208 |
| 2018/0033374 | A1* | 2/2018 | Jeong | G09G 3/2088 |
| 2020/0335044 | A1* | 10/2020 | Kawachi | G09G 3/325 |
| 2020/0388218 | A1* | 12/2020 | Han | G09G 3/3233 |

* cited by examiner

DETECTION CIRCUIT AND DRIVING METHOD THEREOF, AND DISPLAY PANEL

CROSS-REFERENCE TO RELATED APPLICATION

This application claims the benefit of and priority to Chinese Patent Application No. 202010642375.3, filed on Jul. 6, 2020, the disclosure of which is incorporated herein by reference in its entirety.

TECHNICAL FIELD

The present disclosure relates to the field of display technologies and, in particular, to a detection circuit and a driving method thereof, and a display panel.

BACKGROUND

After undergoing a cell test, a display panel will be subjected to other processes, such as bonding a gate driving circuit and a source driving circuit, aging processing, shading processing for a fan-shaped wiring area, polarizer attachment, dispensing, packaging, and the like. The above-mentioned processes may cause defects such as line defects and dots defects in the display panel.

It should be noted that the information disclosed in the Background section above is only for enhancing the understanding of the background of the present disclosure, and thus may include information that does not constitute prior art known to those of ordinary skill in the art.

SUMMARY

The present disclosure provides a detection circuit, a driving method thereof, and a display panel.

Other characteristics and advantages of the present disclosure will become apparent through the following detailed description, or be learned partially through the practice of the present disclosure.

According to an aspect of the present disclosure, there is provided a detection circuit applied to a display panel. The display panel includes a first pin group for connecting a first gate driving circuit, a second pin group for bonding a second gate driving circuit, a third pin group for connecting a source driving circuit, and the display panel further includes display sub-pixels. A pixel driving circuit of each of the display sub-pixels includes a switching transistor, a detection transistor, and a driving transistor, a second electrode of the switching transistor being connected to a gate of the driving transistor, a first electrode of the detection transistor being connected to a second electrode of the driving transistor. The first gate driving circuit is configured to provide a gate driving signal to the switching transistor, the second gate driving circuit is configured to provide a gate driving signal to the detection transistor, and the source driving circuit is configured to provide a data signal to the gate of the driving transistor through the switching transistor, where gates of the switching transistors located in a same pixel row are coupled through a first gate line, and gates of the detection transistors located in a same pixel row are coupled through a second gate line, first electrodes of the switching transistors located in a same pixel column are coupled through a first data line, and second electrodes of the detection transistors located in a same pixel column are coupled through a sensing signal line. The first pin group includes a plurality of first pins, the second pin group includes a plurality of second pins, and the third pin group includes a plurality of third pins. The detection circuit includes: a plurality of first detection circuits, a plurality of second detection circuits, and a plurality of third detection circuits. The first detection circuits and the first gate lines are disposed in a one-to-one correspondence, and the first detection circuit is connected to the first pin, a first control signal terminal, a first detection signal terminal and the first gate line corresponding to the first detection circuit, and the first detection circuit is configured to transmit a signal of the first pin to the first detection signal terminal in response to a control signal, and configured to transmit a signal of the first detection signal terminal to the first gate line in response to a signal of the first control signal terminal. The second detection circuits and the second gate lines are disposed in a one-to-one correspondence, and the second detection circuit is connected to the second pin, a second control signal terminal, a second detection signal terminal and the second gate line corresponding to the second detection circuit, and the second detection circuit is configured to transmit a signal of the second pin to the second detection signal terminal in response to a control signal, and configured to transmit a signal of the second detection signal terminal to the second gate line in response to a signal of the second control signal terminal. The third detection circuits are disposed in a one-to-one correspondence with the first data lines and the sensing signal lines located in the same pixel column, and the third detection circuit is connected to the first data line corresponding to the third detection circuit, the sensing signal line corresponding to the third detection circuit, a third detection signal terminal and a third control signal terminal, and is configured to transmit a signal of the third pin to the third detection signal terminal in response to a control signal, and configured to transmit a signal of the third detection signal terminal to the sensing signal line in response to a signal of the third control signal terminal.

In an exemplary embodiment of the present disclosure, the first detection circuit includes a first transistor and a second transistor. A first electrode of the first transistor is connected to the first pin, a second electrode of the first transistor is connected to the first detection signal terminal, and a gate of the first transistor is connected to the first pin. A first electrode of the second transistor is connected to the first detection signal terminal, a second electrode of the second transistor is connected to the first gate line, and a gate of the second transistor is connected to the first control signal terminal.

In an exemplary embodiment of the present disclosure, the second detection circuit includes a third transistor and a fourth transistor. A first electrode of the third transistor is connected to the second pin, a second electrode of the third transistor is connected to the second detection signal terminal, and a gate of the third transistor is connected to the second pin. A first electrode of the fourth transistor is connected to the second detection signal terminal, a second electrode of the fourth transistor is connected to the second gate line, and a gate of the fourth transistor is connected to the second control signal terminal.

In an exemplary embodiment of the present disclosure, the third detection circuit is configured to transmit the signal of the third pin to the third detection signal in response to a signal of the first data line, and the third detection circuit includes: a fifth transistor and a sixth transistor. A first electrode of the fifth transistor is connected to the third pin, a second electrode of the fifth transistor is connected to the third detection signal terminal, and a gate of the fifth transistor is connected to the first data line. A first electrode of the sixth transistor is connected to the sensing signal line, a second electrode of the sixth transistor is connected to the third detection signal terminal, and a gate of the sixth transistor is connected to the third control signal terminal.

In an exemplary embodiment of the present disclosure, the third detection circuit is configured to transmit the signal of the third pin to the third detection signal terminal in response to a signal of a fourth control signal terminal, and the third detection circuit includes: a fifth transistor and a sixth transistor. A first pole of the fifth transistor is connected to the third pin, a second electrode of the fifth transistor is connected to the third detection signal terminal, and a gate of the fifth transistor is connected to the fourth control signal terminal. A first electrode of the sixth transistor is connected to the sensing signal line, a second electrode of the sixth transistor is connected to the third detection signal terminal, and a gate of the sixth transistor is connected to the third control signal terminal.

In an exemplary embodiment of the present disclosure, one or more of the first detection circuits, the second detection circuits, and the third detection circuits are integrated in a dummy pixel area of the display panel.

In an exemplary embodiment of the present disclosure, the plurality of the first detection circuits are connected to the same first control signal terminal; the plurality of the second detection circuits are connected to the same second control signal terminal; and the plurality of the third detection circuits are connected to the same third control signal terminal.

In an exemplary embodiment of the present disclosure, the display panel further includes a plurality of dummy sub-pixels and a plurality of second data lines, and dummy sub-pixels located in a same column are coupled through the second data line, and the plurality of first detection circuits is connected to the same first control signal terminal through a same second data line; and the plurality of second detection circuits are connected to the same second control signal terminal through a same second data line.

In an exemplary embodiment of the present disclosure, the display panel further includes a plurality of dummy sub-pixels and a plurality of third gate lines, and dummy sub-pixels located in a same row are coupled through the third gate line; and the plurality of third detection circuits are connected to the same third control signal terminal through a same third gate line.

In an exemplary embodiment of the present disclosure, the detection circuit further includes: a detection signal determination sub-circuit, connected to the first detection signal terminal, the second detection signal terminal, and the third detection signal terminal, and configured to determine a state of the display panel according to signals of the first detection signal terminal, the second detection signal terminal, and the third detection signal terminal, respectively.

In an exemplary embodiment of the present disclosure, the display panel includes a first wiring area located on one side of the first gate line along an extending direction of the first gate line, and the display panel further includes a first connection line, located in the first wiring area, and the first detection circuit being connected to the first pin through the first connection line. The display panel further includes a second wiring area located on the other side of the first gate line along the extending direction of the first gate line, and the display panel further includes: a second connection line, located in the second wiring area, and the second detection circuit being connected to the second pin through the second connection line. The display panel further includes a third wiring area located on one side of the first data line along an extending direction of the first data line, and the display panel further includes: a third connection line, located in the third wiring area, and the third detection circuit being connected to the third pin through the third connection line.

In an exemplary embodiment of the present disclosure, a first electrode of the driving transistor is connected to a first power source terminal, and the pixel driving circuit further includes a capacitor, coupled between a gate and a second electrode of the driving transistor.

According to an aspect of the present disclosure, there is provided a detection circuit driving method for driving the above detection circuit, and the driving method includes steps described below.

In a first detection stage, providing a switch-off signal to the first control signal terminal, and connecting the first pin and the first detection signal terminal in response to a control signal, so that a connecting state between the first pin group and the first gate driving circuit is detected through the first detection signal terminal;

providing a switch-off signal to the second control signal terminal, and connecting the second pin and the second detection signal terminal in response to a control signal, so that a connecting state between the second pin group and the second gate driving circuit is detected through the second detection signal terminal; and providing a switch-off signal to the third control signal terminal, and connecting the third pin and the third detection signal terminal in response to a control signal, so that a connecting state between the third pin group and the source driving circuit is detected through the third detection signal terminal.

In a second detection stage, providing a switch-on signal to the first control signal terminal, the second control signal terminal, and the third control signal terminal, and connecting the first pin and the first detection signal terminal in response to a control signal, connecting the second pin and the second detection signal terminal in response to a control signal, and connecting the third pin and the third detection signal terminal in response to a control signal, so that a driving state of the display sub-pixel is detected through the third detection signal terminal.

In an exemplary embodiment of the present disclosure, the detection circuit includes a detection signal determination sub-circuit, and the driving method includes:

determining a connecting state between the first pin group and the first gate driving circuit by the detection signal determination sub-circuit;

determining a connecting state between the second pin group and the second gate driving circuit by the detection signal determination sub-circuit; and determining the driving state of the display sub-pixel by the detection signal determination sub-circuit.

According to an aspect of the present disclosure, there is provided a display panel including the above-mentioned detection circuit.

The present disclosure provides a detection circuit, a driving method thereof, and a display panel. The detection circuit is applied to the display panel. The display panel includes a first pin group for connecting a first gate driving circuit, a second pin group for connecting a second gate driving circuit, a third pin group for connecting a source driving circuit, and the display panel further includes a display sub-pixel, and a pixel driving circuit of the display sub-pixel includes a switching transistor, a detection transistor, and a driving transistor, a second electrode of the switching transistor is connected to a gate of the driving transistor, a first electrode of the detection transistor is connected to a second electrode of the driving transistor, and the first gate driving circuit is configured to provide a gate driving signal to the switching transistor, the second gate driving circuit is configured to provide a gate driving signal to the detection transistor, and the source driving circuit is configured to provide a data signal to the gate of the driving transistor through the switching transistor, wherein gates of the switching transistors located in a same pixel row are coupled through a first gate line, and gates of the detection transistors located in a same pixel row are coupled through a second gate line, first electrodes of the switching transistors located in a same pixel column are coupled through a first data line, and second electrodes of the detection transistors located in a same pixel column are coupled through a sensing signal line, the first pin group includes a plurality of first pins, the second pin group includes a plurality of second pins, and the third pin group includes a plurality of third pins, and the detection circuit includes: a plurality of first detection circuits, a plurality of second detection circuits, and a plurality of third detection circuits. The first detection circuits and the first gate lines are disposed in a one-to-one correspondence, and the first detection circuit is connected to the first pin, a first control signal terminal, a first detection signal terminal and the first gate line corresponding to the first detection circuit, and the first detection circuit is configured to transmit a signal of the first pin to the first detection signal terminal in response to a control signal, and configured to transmit a signal of the first detection signal terminal to the first gate line in response to a signal of the first control signal terminal; the second detection circuits and the second gate lines are disposed in a one-to-one correspondence, and the second detection circuit is connected to the second pin, a second control signal terminal, a second detection signal terminal and the second gate line corresponding to the second detection circuit, and the second detection circuit is configured to transmit a signal of the second pin to the second detection signal terminal in response to a control signal, and configured to transmit a signal of the second detection signal terminal to the second gate line in response to a signal of the second control signal terminal; and the third detection circuits are disposed in a one-to-one correspondence with the first data lines and the sensing signal lines located in the same pixel column, and the third detection circuit is connected to the first data line corresponding to the third detection circuit, the sensing signal line corresponding to the third detection circuit, a third detection signal terminal and a third control signal terminal, and is configured to transmit a signal of the third pin to the third detection signal terminal in response to a control signal, and configured to transmit a signal of the third detection signal terminal to the sensing signal line in response to a signal of the third control signal terminal.

It should be noted that the above general description and the following detailed description are merely exemplary and explanatory and should not be construed as limiting of the disclosure.

BRIEF DESCRIPTION OF THE DRAWINGS

The accompanying drawings, which are incorporated in the specification and constitute a part of the specification, show exemplary embodiments of the present disclosure. The drawings along with the specification explain the principles of the present disclosure. It is understood that the drawings in the following description show only some of the embodiments of the present disclosure, and other drawings may be obtained by those skilled in the art without departing from the drawings described herein.

DETAILED DESCRIPTION

Figure 1:
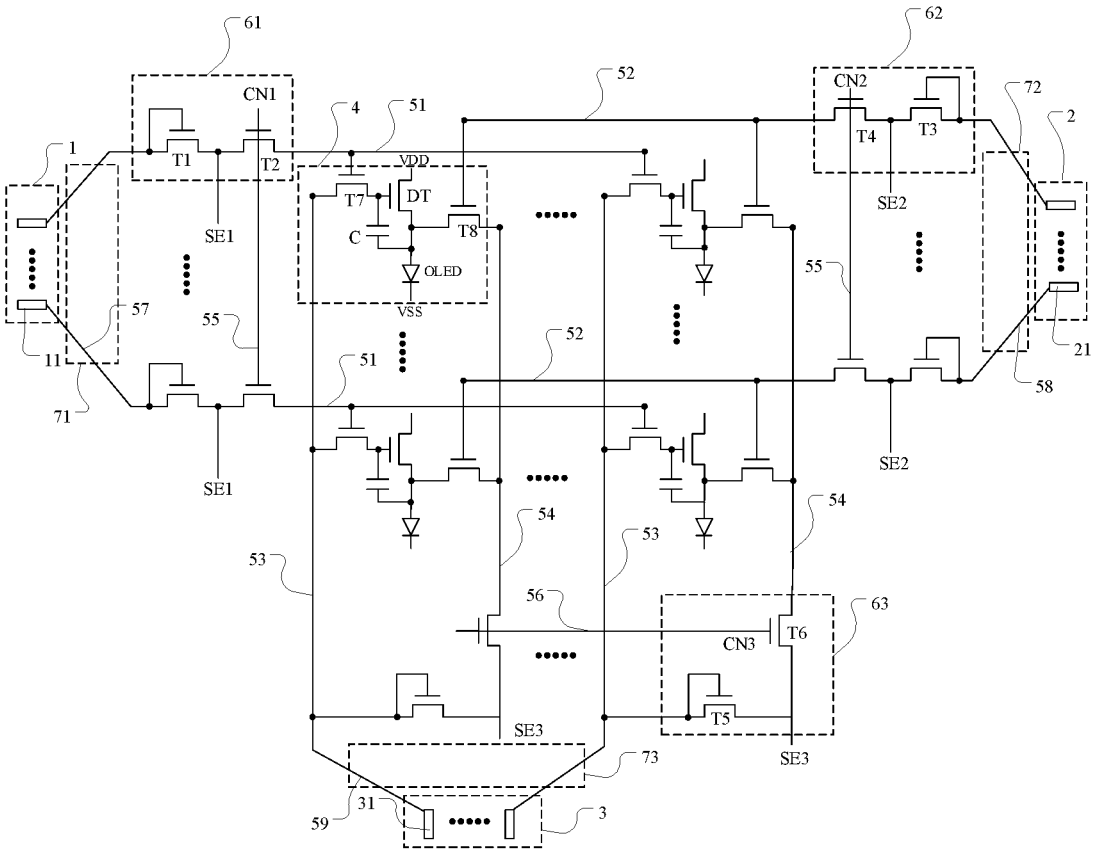
FIG. 1 is a schematic structural diagram of an exemplary embodiment of a detection circuit of the present disclosure.

Example embodiments will now be described more fully with reference to the accompanying drawings. However, the embodiments may be implemented in a variety of forms and should not be construed as being limited to the examples set forth herein; rather, these embodiments are provided so that the present disclosure will be more complete so as to convey the idea of the exemplary embodiments to those skilled in this art. The same reference numerals in the drawings denote the same or similar parts, and the repeated description thereof will be omitted.

Although the relative terms such as "above" and "below" are used in the specification to describe the relative relationship of one component to another component shown, these terms are only for convenience in this specification, for example, they are based on an exemplary direction shown in the drawings. It will be understood that if the device shown is flipped upside down, the component described "above" will become the component "below". Other relative terms, such as "high", "low", "top", "bottom", "left", "right", etc., also have similar meanings. When a structure is "on" another structure, it may mean that a structure is integrally formed on another structure, or that a structure is "directly" disposed on another structure, or that a structure is "indirectly" disposed on another structure through other structures.

The terms "one", "a", "the", and "said", are used to indicate that there are one or more elements/components or the like; the terms "include", "contain" and "have" are used to indicate an open meaning of including and means that there may be additional elements/components/etc. in addition to the listed elements/components/etc.; the terms "first", "second" and "third" etc. are used only as markers, and do not limit the number of objects.

An exemplary embodiment provides a detection circuit that may be applied to a display panel. FIG. 1 is a schematic structural diagram of an exemplary embodiment of a detection circuit of the present disclosure. As shown in FIG. 1, the display panel may include a first pin group 1 for bonding a first gate driving circuit, a second pin group 2 for bonding a second gate driving circuit, a third pin group 3 for bonding a source driving circuit. The first pin group 1 may include a plurality of first pins 11, the second pin group 2 may include a plurality of second pins 21, and the third pin group 3 may include a plurality of third pins 31. Output terminals of the first gate driving circuit may be bonded to the first pins in a one-to-one correspondence, respectively, and output terminals of the second gate driving circuit may be bonded to the second pins in a one-to-one correspondence, respectively, and output terminals of the source driving circuit may be bonded to the third pins in a one-to-one correspondence, respectively. The display panel may further include a plurality of display sub-pixels. A pixel driving circuit 4 of each display sub-pixel may include a switching transistor T7, a detection transistor T8, and a driving transistor DT. A second electrode of the switching transistor T7 is connected to a gate of the driving transistor DT, a first electrode of the detection transistor T8 is connected to a second electrode of the driving transistor DT. The first gate driving circuit is configured to provide a gate driving signal to the switching transistor T7, the second gate driving circuit is configured to provide a gate driving signal to the detection transistor T8, and the source driving circuit is configured to provide a data signal to the gate of the driving transistor DT through the switching transistor T7. Gates of the switching transistors T7 located in a same pixel row are coupled through a first gate line 51, gates of the detection transistor T8 located in a same pixel row are coupled through a second gate line 52, and first electrodes of the switching transistors T7 located in a same pixel column are coupled through a first data line 53. The first data line 53 may be directly connected to the third pin. Second electrodes of the detection transistors T8 located in a same pixel column are coupled through a sensing signal line 54. The detection circuit may include: a plurality of first detection circuits 61, a plurality of second detection circuits 62, and a plurality of third detection circuits 63. The first detection circuits 61 and the first gate lines 51 are disposed in a one-to-one correspondence, and the first detection circuit 61 is connected to the first pin 11, a first control signal terminal CN1, a first detection signal terminal SE1 and a first gate line 51 corresponding to the first detection circuits 61. The first detection circuit 61 is configured to transmit a signal of the first pin 11 to the first detection signal terminal SE1 in response to the signal of the first pin 11, and configured to transmit a signal of the first detection signal terminal SE1 to the first gate line 51 in response to a signal of the first control signal terminal CN1. The second detection circuits and the second gate lines 52 are disposed in a one-to-one correspondence, and the second detection circuit is connected to the second pin 21, a second control signal terminal CN2, a second detection signal terminal SE2 and a second gate line 52 corresponding to the second detection circuits 62. The second detection circuit is configured to transmit a signal of the second pin 21 to the second detection signal terminal SE2 in response to the signal of the second pin 21, and configured to transmit the signal of the second detection signal terminal SE2 to the second gate line 52 in response to a signal of the second control signal terminal CN2. The third detection circuits are disposed in a one-to-one correspondence with the first data lines 53 and the sensing signal lines 54 located in the same pixel column, and the third detection circuit is connected to a first data line 53 corresponding to the third detection circuit, a sensing signal line 54 corresponding to the third detection circuit, a third detection signal terminal SE3 and a third control signal terminal CN3. The third detection circuit is configured to transmit a signal of the third pin 31 to the third detection signal terminal SE3 in response to the signal of the third pin 31, and configured to transmit the signal of the third detection signal terminal SE3 to the sensing signal line 54 in response to a signal of the third control signal terminal CN3.

In the exemplary embodiment, as shown in FIG. 1, the first detection circuit 61 may include a first transistor T1 and a second transistor T2. A first electrode of the first transistor T1 is connected to the first pin 11, a second electrode of the first transistor T1 is connected to the first detection signal terminal SE1, and a gate of the first transistor T1 is connected to the first pin 11. A first electrode of the second transistor T2 is connected to the first detection signal terminal SE1, a second electrode of the second transistor T2 is connected to the first gate line 51, and a gate of the second transistor T2 is connected to the first control signal terminal CN1.

In the exemplary embodiment, as shown in FIG. 1, the second detection circuit 62 may include a third transistor T3 and a fourth transistor T4. A first electrode of the third transistor T3 is connected to the second pin 21, a second electrode of the third transistor T3 is connected to the second detection signal terminal SE2, and a gate of the third transistor T3 is connected to the second pin 21. A first electrode of the fourth transistor T4 is connected to the second detection signal terminal SE2, a second electrode of the fourth transistor T4 is connected to the second gate line 52, and a gate of the fourth transistor T4 is connected to the second control signal terminal CN2.

In the exemplary embodiment, as shown in FIG. 1, the third detection circuit 63 may include a fifth transistor T5 and a sixth transistor T6. A first electrode of the fifth transistor T5 is connected to the third pin 31, a second electrode of the fifth transistor T5 is connected to the third detection signal terminal SE3, and a gate of the fifth transistor T5 is connected to the first data line 53. A first electrode of the sixth transistor T6 is connected to the sensing signal line 54, a second electrode of the sixth transistor T6 is connected to the third detection signal terminal SE3, and a gate of the sixth transistor T6 is connected to the third control signal terminal CN3.

In the exemplary embodiment, as shown in FIG. 1, a first electrode of the driving transistor DT may be connected to a first power source VDD, and the pixel driving circuit may further include a capacitor C that may be coupled between a gate and a second electrode of the driving transistor DT. The second electrode of the driving transistor DT may be connected to a light emitting unit OLED, and the other terminal of the light emitting unit OLED may be connected to a second power source VSS.

In the exemplary embodiment, the display sub-pixel may refer to a sub-pixel capable of emitting light, which is mainly different from a non-luminous dummy sub-pixel around the display sub-pixel. As shown in FIG. 1, the first detection circuits 61 and the second detection circuits 62 may be located on opposite sides of the display panel. As shown in FIG. 1, the first detection signal terminals SE1 connected to each of the first detection circuits are disposed individually, the second detection signal terminals SE2 connected to each of the second detection circuits are disposed individually, and the third detection signal terminals SE3 connected to each of the third detection circuits are disposed individually. In the exemplary embodiment, the first to eighth transistors and the driving transistor may be P-type transistors or N-type transistors. The exemplary embodiment takes the N-type transistor as an example for description. It should be understood that, in other exemplary embodiments, the first detection circuit 61, the second detection circuit 62, the third detection circuit 63, and the pixel driving circuit 4 may also have other structures. The first detection circuits and the second detection circuits may also be located on the same side of the display panel, which falls within the protection scope of the present disclosure.

In the exemplary embodiment, a driving method of the detection circuit may include a first detection stage and a second detection stage.

In the first detection stage, a switch-off signal may be input to the first control signal terminal CN1, and the plurality of output terminals of the first gate driving circuit are bonded to the plurality of first pins 11 in the first pin group 1 in a one-to-one correspondence, respectively. A valid level (may be in a high level) may be output to the first pins 11 step by step through the first gate driving circuit. If a certain output terminal of the first gate driving circuit is well bonded with the first pin, the first transistor T1 is turned on through the signal output from the output terminal so that the first pin 11 is connected with the first detection signal terminal SE1. At this time, a level of the first detection signal terminal SE1 is the valid level output by the output terminal. If a certain output terminal of the first gate driving circuit is not well bonded with the first pin 11, the first transistor T1 is not turned on through the signal output from the output terminal, and at this time, the level of the first detection signal terminal SE1 is an invalid level. Therefore, a bonding state between the first gate driving circuit and the first pin group may be detected by detecting the level of the first detection signal terminal.

Similarly, in the first detection stage, a switch-off signal may also be input to the second control signal terminal, and the plurality of output terminals of the second gate driving circuit are bonded to the plurality of second pins 21 in the second pin group 2 in a one-to-one correspondence, respectively. A valid level (may be in a high level) may be output to the second pins 21 step by step through the second gate driving circuit. If a certain output terminal of the second gate driving circuit is well bonded with the second pin 21, the third transistor T3 is turned on through the signal output from the output terminal so that the second pin 21 is connected to the second detection signal terminal SE2. At this time, a level of the second detection signal terminal SE2 is the valid level output by the output terminal. If a certain output terminal of the second gate driving circuit is not well bonded with the second pin 21, the third transistor T3 is not turned on through the signal output from the output terminal, and at this time, a level of the second detection signal terminal SE2 is an invalid level. Therefore, the bonding state between the second gate driving circuit and the second pin group may be detected by detecting the level of the second detection signal terminal SE2.

In the first detection stage, a switch-off signal may also be input to the third control signal terminal, and the plurality of output terminals of the source driving circuit are bonded to the plurality of third pins 31 in the third pin group 3 in a one-to-one correspondence, respectively. A valid level (may be in a high level) may be output to the third pins 31 step by step through the source driving circuit. If a certain output terminal of the source driving circuit is well bonded with the third pin 31, the fifth transistor T5 is turned on through a signal output from the output terminal so that the third pin 31 is connected with the third detection signal terminal SE3. At this time, a level of the third detection signal terminal SE3 is the valid level output by the output terminal. If a certain output terminal of the source driving circuit is not well bonded with the third pin 31, the fifth transistor T5 is not turned on through a signal output from the output terminal, and at this time, a level of the third detection signal terminal SE3 is an invalid level. Therefore, the bonding state between the source driving circuit and the third pin group may be detected by detecting the level of the third detection signal terminal SE3.

In the second detection stage, a switch-on signal may be input to the first control signal terminal, the second control signal terminal, and the third control signal terminal, so that the second transistor T2 in the first detection circuit, the fourth transistors T4 in the second detection circuit, and the sixth transistor T6 in the third detection circuit are turned on. The first gate driving circuit outputs the valid level to the first pin group step by step, the second gate driving circuit outputs the valid level to the second pin group step by step, and the source driving circuit outputs the valid level to the third pin group. The switching transistor T7 in the pixel driving circuit 4 is turned on, the detection transistor T8 is turned on, the valid level output by the source driving circuit turns on the driving transistor DT through the switching transistor T7, and the third detection signal terminal SE3 is connected to the first power source VDD. Therefore, whether the pixel driving circuit is well driven may be detected by detecting the voltage of the third detection signal terminal SE3. For example, if the pixel driving circuit is well driven, the voltage of the third detection signal terminal SE3 should be equal to a voltage of the first power source VDD minus a threshold voltage of the driving transistor DT. Therefore, a detected voltage of the third detection signal terminal SE3 is compared with the above theoretical voltage. If a difference is less than a preset voltage value, it may be considered that the pixel driving circuit is well driven, otherwise the pixel driving circuit is not well driven. For another example, a voltage of a certain third detection signal terminal SE3 may be compared with a voltage of another third detection signal terminal SE3. If a voltage difference between the voltage of the third detection signal terminal SE3 and the voltage of another third detection signal terminal SE3 is less than a preset value, it may be considered that the pixel driving circuit is well driven. Otherwise, the pixel driving circuit is not well driven.

The detection circuit is not only capable of detecting the bonding state of the first gate driving circuit, the second gate driving circuit, and the source driving circuit in the display panel, but also capable of detecting the driving state of display sub-pixels. In addition, the detection circuit may also quickly locate a position of the pixel driving circuit where the driving failure occurs through the positions of the third detection signal terminal SE3, the second detection signal terminal SE2, and the first detection signal terminal SE1.

In the exemplary embodiment, as shown in FIG. 1, one or more of the first detection circuits 61, the second detection circuits 62, and the third detection circuits 63 are integrated in a dummy pixel area of the display panel. For example, transistors and capacitors in the first detection circuits 61, the second detection circuits 62, and the third detection circuits 63 may be formed in a same layer as transistors and capacitors of the pixel driving circuits of the display panel. Integrating the first detection circuits 61, the second detection circuits 62, and the third detection circuits 63 in the dummy pixel area may prevent the first detection circuits 61, the second detection circuits 62, and the third detection circuits 63 from affecting a display pixel area. It should be understood that, in other exemplary embodiments, the first detection circuits 61, the second detection circuits 62, and the third detection circuits 63 may also be integrated in the display pixel area. In addition, the first detection circuits 61, the second detection circuits 62, and the third detection circuits 63 may also be externally connected to the display panel, that is, the first detection circuits 61, the second detection circuits 62, and the third detection circuits 63 are disposed individually, and connected to the display panel through plug-in interfaces.

In the exemplary embodiment, as shown in FIG. 1, the plurality of first detection circuits 61 may be connected to a same first control signal terminal CN1; the plurality of second detection circuits 62 are connected to a same second control signal terminal CN2; and the plurality of third detection circuits 63 are connected to a same third control signal terminal CN3. As shown in FIG. 1, the display panel further includes a plurality of dummy sub-pixels (not shown) and a plurality of second data lines 55, and dummy sub-pixels located in a same column are coupled through the second data line 55, and the plurality of first detection circuits 61 may be connected to the same first control signal terminal CN1 thought a same second data line 55; and the plurality of second detection circuits 62 may be connected to the same second control signal terminal CN2 through a same second data line 55. The detection circuit may further include a control signal generating circuit configured to provide control signals to the first control signal terminal CN1 and the second control signal terminal CN2 through different second data lines 55, respectively.

In the exemplary embodiment, as shown in FIG. 1, the display panel further includes a plurality of dummy sub-pixels (not shown) and a plurality of third gate lines 56. The dummy sub-pixels located in a same row are coupled through the third gate line 56; and the plurality of third detection circuits 63 may be connected to the same third control signal terminal CN3 through a same third gate line 56. The control signal generating circuit may provide the control signal to the third control signal terminal CN3 through the third gate line 56.

In the exemplary embodiment, the detection circuit may further include a detection signal determination sub-circuit, connected to the first detection signal terminal SE1, the second detection signal terminal SE2, and the third detection signal terminal SE3. The detection signal determination sub-circuit may determine the bonding state of the first gate driving circuit, the second gate driving circuit, the source driving circuit and the driving state of the pixel driving circuit according to the above defect determination method.

In the exemplary embodiment, as shown in FIG. 1, the display panel may further include a first wiring area 71 located on one side of the first gate line 51 along an extending direction of the first gate line 51, and the display panel further includes a first connection line 57 located in the first wiring area 71. The first detection circuit 61 is connected to the first pin 11 through the first connection line 57. The display panel further includes a second wiring area 72 located on the other side of the first gate line 51 along the extending direction of the first gate line 51, and the display panel further includes a second connection line 58 located in the second wiring area 72. The second detection circuit 62 may be connected to the second pin 21 through the second connection line 58. The display panel may further include a third wiring area 73 located on one side of the first data line 53 along an extending direction of the first data line 53, and the display panel further includes a third connection line 59 located in the third wiring area 73. The third detection circuit 63 may be connected to the third pin 31 through the third connection line 59. The first wiring area 71, the second wiring area 72, and the third wiring area 73 may be fan-shaped wiring areas located in a frame area of the display panel.

Figure 2:
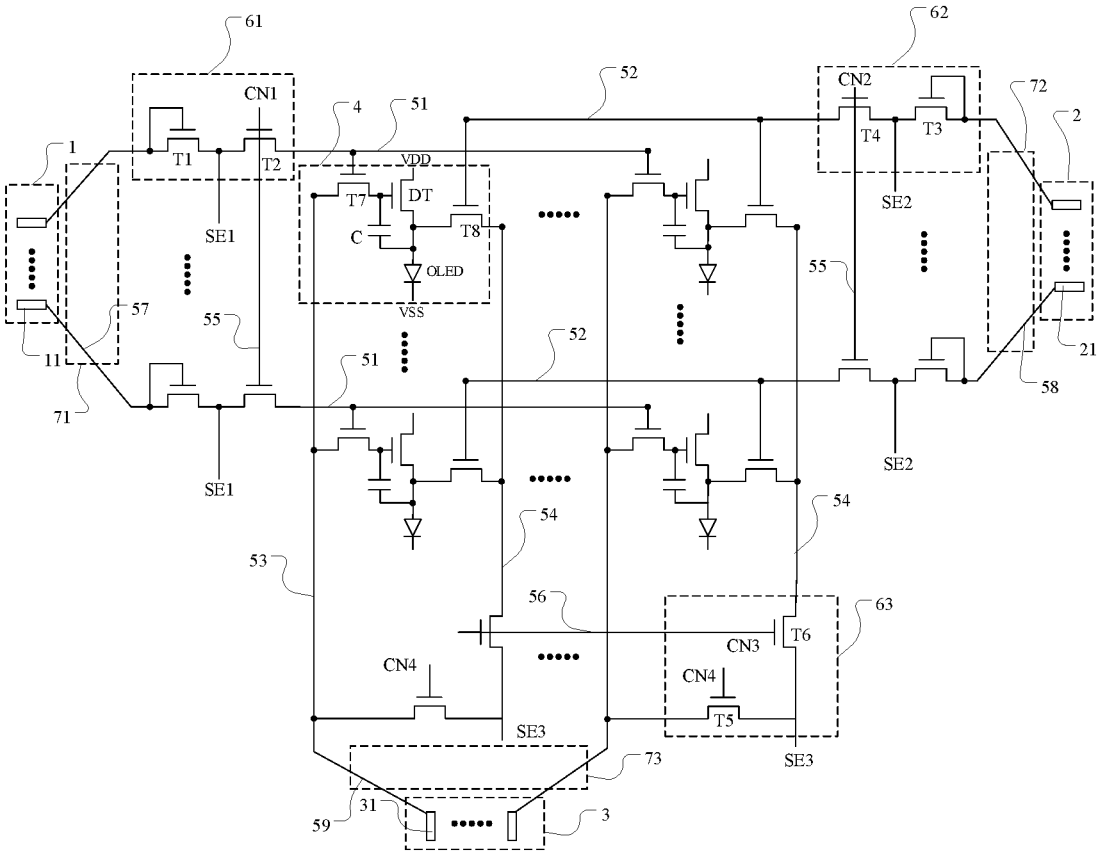
FIG. 2 is a schematic structural diagram of another exemplary embodiment of a detection circuit of the present disclosure.

FIG. 2 is a schematic structural diagram of another exemplary embodiment of a detection circuit of the present disclosure. As shown in FIG. 2, the third detection circuit 63 may be configured to transmit the signal of the third pin 31 to the third detection signal terminal SE3 in response to a signal of a fourth control signal terminal CN4. The third detection circuit 63 may include a fifth transistor T5 and a sixth transistor T6. A first electrode of the fifth transistor T5 is connected to the third pin 31, a second electrode of the fifth transistor T5 is connected to the third detection signal terminal SE3, and a gate of the fifth transistor T5 is connected to the fourth control signal terminal CN4. A first electrode of the sixth transistor T6 is connected to the sensing signal line 54, a second electrode of the sixth transistor T6 is connected to the third detection signal terminal SE3, and a gate of the sixth transistor T6 is connected to the third control signal terminal CN3. Similarly, in other exemplary embodiments, the first detection circuit 61 may transmit the signal of the first pin to the first detection signal terminal in response to a signal of another control signal terminal, and the second detection circuit 62 may transmit the signal of the second pin to the second detection signal terminal in response to a signal of another control signal terminal.

Figure 3:
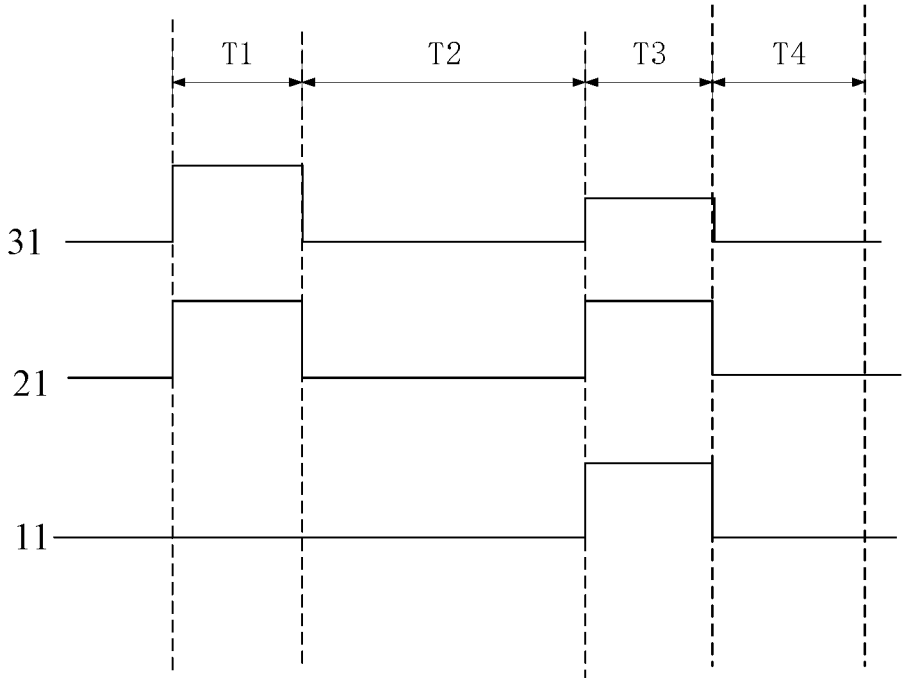
FIG. 3 is a timing diagram of each node in a driving method of a pixel driving circuit in an exemplary embodiment of the present disclosure.

In the exemplary embodiment, the detection circuit may also be configured to detect the threshold voltage of the driving transistor in the pixel driving circuit. FIG. 3 is a timing diagram of each node during a driving method of a pixel driving circuit in an exemplary embodiment of the present disclosure. As shown in FIG. 3, reference numeral 11 refers to a timing of the first pin 11, 12 refers to a timing of the second pin, and 13 refers to a timing of the third pin. The driving method of the pixel driving circuit includes four stages: a data writing stage T1, a light emitting stage T2, a threshold detection stage T3, and a compensation stage T4. When the pixel driving circuit is in the above four stages, a switch-on signal is provided to the first control signal terminal CN1, the second control signal terminal CN2, and the third control signal terminal CN3 to turn on the second transistor T2, the fourth transistor T4 and the sixth transistor T6. In the data writing stage T1, the first gate driving circuit inputs the valid level to the first pin 11 to turn on the first transistor T1, and the source driving circuit inputs the valid data signal to the third pin. At this time, the switching transistor T7 is turned on, and the valid data signal is transmitted to the gate of the driving transistor DT and stored in the capacitor C. In the light-emitting phase T2, the source driving circuit stops providing the valid data signal to the third pin, and the first gate driving circuit inputs the invalid signal to the first pin to turn off the first transistor T1. At this time, the driving transistor DT is turned on under the action of its gate voltage to drive the light emitting unit OLED to emit light. In the threshold detection stage T3, the source driving circuit inputs a data signal with a lower level to the third pin, and the data signal is not enough to make the light emitting unit OLED emit light. The first gate driving circuit inputs the valid level to the first pin to turn on the first transistor T1, and at the same time, the second gate driving circuit inputs the valid level to the second pin to turn on the third transistor T3 and the detection transistor T8. At this time, the driving transistor DT is turned on, and a voltage of the second electrode of the driving transistor DT gradually increases, until the voltage of the second electrode of the driving transistor is equal to a voltage of the first power terminal minus the threshold voltage of the driving transistor, and an output current of the driving transistor DT is zero at the same time. Therefore, the voltage of the second electrode of the driving transistor DT is detected through the sensing signal line 54 when the output current of the driving transistor DT is zero, that is, the threshold voltage of the driving transistor may be obtained. In the compensation stage T4, the data signal is compensated according to the threshold voltage of the driving transistor.

An exemplary embodiment further provides a detection circuit driving method for driving the above detection circuit, and the driving method includes steps described below.

In a first detection stage, providing a switch-off signal to the first control signal terminal, and connecting the first pin and the first detection signal terminal in response to a control signal, so that a bonding state between the first pin group and the first gate driving circuit is detected through the first detection signal terminal;

providing a switch-off signal to the second control signal terminal, and connecting the second pin and the second detection signal terminal in response to a control signal, so that a bonding state between the second pin group and the second gate driving circuit is detected through the second detection signal terminal; and providing a switch-off signal to the third control signal terminal, and connecting the third pin and the third detection signal terminal in response to a control signal, so that a bonding state between the third pin group and the source driving circuit is detected through the third detection signal terminal;

In a second detection stage, providing a switch-on signal to the first control signal terminal, the second control signal terminal, and the third control signal terminal, and connecting the first pin and the first detection signal terminal in response to a control signal, connecting the second pin and the second detection signal terminal in response to a control signal, and connecting the third pin and the third detection signal terminal in response to a control signal, so that a driving state of the display sub-pixel is detected through the third detection signal terminal.

In an exemplary embodiment of the present disclosure, the detection circuit includes a detection signal determination sub-circuit, and the driving method includes:

determining a bonding state between the first pin group and the first gate driving circuit by the detection signal determination sub-circuit;

determining a bonding state between the second pin group and the second gate driving circuit by the detection signal determination sub-circuit; and determining the driving state of the display sub-pixel by the detection signal determination sub-circuit.

The detection circuit driving method is described in detail in the above content and will not be repeated here.

An exemplary embodiment further provides a display panel including the above-mentioned detection circuit. The display panel may be used in display devices such as mobile phones, tablet computers, and televisions.

Other embodiments of the present disclosure will be apparent to those skilled in the art after those skilled in the art consider the specification and practice the technical solutions disclosed herein. The present application is intended to cover any variations, uses, or adaptations of the present disclosure, which are in accordance with the general principles of the present disclosure and include common general knowledge or conventional technical means in the art that are not disclosed in the present disclosure. The specification and embodiments are illustrative, and the real scope and spirit of the present disclosure is defined by the appended claims.

It should be understood that the present disclosure is not limited to the precise structures that have been described above and shown in the drawings, and various modifications and changes may be made without departing from the scope thereof. The scope of the present disclosure is limited only by the appended claims.

What is claimed is:

1. A detection circuit applied to a display panel, the display panel comprising a first pin group for connecting a first gate driving circuit, a second pin group for connecting a second gate driving circuit, a third pin group for connecting a source driving circuit, the first pin group comprising a plurality of first pins, the second pin group comprising a plurality of second pins, and the third pin group comprising a plurality of third pins, and the display panel further comprising a plurality of display sub-pixels, and a pixel driving circuit of each of the display sub-pixels comprising a switching transistor, a detection transistor, and a driving transistor, a second electrode of the switching transistor being connected to a gate of the driving transistor, a first electrode of the detection transistor being connected to a second electrode of the driving transistor, and the first gate driving circuit being configured to provide a gate driving signal to the switching transistor, the second gate driving circuit being configured to provide a gate driving signal to the detection transistor, and the source driving circuit being configured to provide a data signal to the gate of the driving transistor through the switching transistor, wherein gates of switching transistors located in a same pixel row are coupled through a first gate line, and gates of detection transistors located in a same pixel row are coupled through a second gate line, first electrodes of the switching transistors located in a same pixel column are coupled through a first data line, and second electrodes of the detection transistors located in a same pixel column are coupled through a sensing signal line, wherein the detection circuit comprises:

a plurality of first detection circuits, wherein the first detection circuits and first gate lines are disposed in a one-to-one correspondence, and each of the first detection circuits is connected to the first pin, a first control signal terminal, a first detection signal terminal and a first gate line corresponding to the first detection circuit, and each of the first detection circuits is configured to transmit a signal of the first pin to the first detection signal terminal in response to a control signal, and configured to transmit a signal of the first detection signal terminal to the first gate line in response to a signal of the first control signal terminal;

a plurality of second detection circuits, wherein the second detection circuits and second gate lines are disposed in a one-to-one correspondence, and each of the second detection circuits is connected to the second pin, a second control signal terminal, a second detection signal terminal and a second gate line corresponding to the second detection circuit, and each of the second detection circuits is configured to transmit a signal of the second pin to the second detection signal terminal in response to a control signal, and configured to transmit a signal of the second detection signal terminal to the second gate line in response to a signal of the second control signal terminal; and a plurality of third detection circuits, wherein the third detection circuits are disposed in a one-to-one correspondence with first data lines and sensing signal lines located in a same pixel column, and each of the third detection circuits is connected to a first data line corresponding to the third detection circuit, a sensing signal line corresponding to the third detection circuit, a third detection signal terminal and a third control signal terminal, and each of the third detection circuits is configured to transmit a signal of the third pin to the third detection signal terminal in response to a control signal, and configured to transmit a signal of the third detection signal terminal to the sensing signal line in response to a signal of the third control signal terminal.

2. The detection circuit according to claim 1, wherein the first detection circuit comprises:

a first transistor, wherein a first electrode of the first transistor is connected to the first pin, a second electrode of the first transistor is connected to the first detection signal terminal, and a gate of the first transistor is connected to the first pin; and a second transistor, wherein a first electrode of the second transistor is connected to the first detection signal terminal, a second electrode of the second transistor is connected to the first gate line, and a gate of the second transistor is connected to the first control signal terminal.

3. The detection circuit according to claim 1, wherein the second detection circuit comprises:

a third transistor, wherein a first electrode of the third transistor is connected to the second pin, a second electrode of the third transistor is connected to the second detection signal terminal, and a gate of the third transistor is connected to the second pin; and a fourth transistor, wherein a first electrode of the fourth transistor is connected to the second detection signal terminal, a second electrode of the fourth transistor is connected to the second gate line, and a gate of the fourth transistor is connected to the second control signal terminal.

4. The detection circuit according to claim 1, wherein the third detection circuit is configured to transmit the signal of the third pin to the third detection signal in response to a signal of the first data line, and wherein the third detection circuit comprises:

a fifth transistor, wherein a first electrode of the fifth transistor is connected to the third pin, a second electrode of the fifth transistor is connected to the third detection signal terminal, and a gate of the fifth transistor is connected to the first data line; and a sixth transistor, wherein a first electrode of the sixth transistor is connected to the sensing signal line, a second electrode of the sixth transistor is connected to the third detection signal terminal, and a gate of the sixth transistor is connected to the third control signal terminal.

5. The detection circuit according to claim 1, wherein the third detection circuit is configured to transmit the signal of the third pin to the third detection signal terminal in response to a signal of a fourth control signal terminal, and wherein the third detection circuit comprises:

a fifth transistor, wherein a first electrode of the fifth transistor is connected to the third pin, a second electrode of the fifth transistor is connected to the third detection signal terminal, and a gate of the fifth transistor is connected to the fourth control signal terminal; and a sixth transistor, wherein a first electrode of the sixth transistor is connected to the sensing signal line, a second electrode of the sixth transistor is connected to the third detection signal terminal, and a gate of the sixth transistor is connected to the third control signal terminal.

6. The detection circuit according to claim 1, wherein one or more of the first detection circuits, the second detection circuits, and the third detection circuits are integrated in a dummy pixel area of the display panel.

7. The detection circuit according to claim 1, wherein the plurality of first detection circuits are connected to the same first control signal terminal;

the plurality of second detection circuits are connected to the same second control signal terminal; and the plurality of third detection circuits are connected to the same third control signal terminal.

8. The detection circuit according to claim 7, wherein the display panel further comprises a plurality of dummy sub-pixels and a plurality of second data lines, and dummy sub-pixels located in a same column are coupled through the second data line, and the plurality of first detection circuits are connected to the same first control signal terminal through a same second data line; and the plurality of second detection circuits are connected to the same second control signal terminal through a same second data line.

9. The detection circuit according to claim 7, wherein the display panel further comprises a plurality of dummy sub-pixels and a plurality of third gate lines, and dummy sub-pixels located in a same row are coupled through the third gate line; and the plurality of third detection circuits are connected to the same third control signal terminal through a same third gate line.

10. The detection circuit according to claim 1, further comprising:

a detection signal determination sub-circuit, connected to the first detection signal terminal, the second detection signal terminal, and the third detection signal terminal, and configured to determine a state of the display panel according to signals of the first detection signal terminal, the second detection signal terminal, and the third detection signal terminal, respectively.

11. The detection circuit according to claim 1, wherein the display panel comprises a first wiring area located on one side of the first gate line along an extending direction of the first gate line, and the display panel further comprises a first connection line located in the first wiring area, and the first detection circuit being connected to the first pin through the first connection line;

the display panel further comprises a second wiring area located on the other side of the first gate line along the extending direction of the first gate line, and the display panel further comprises a second connection line located in the second wiring area, and the second detection circuit being connected to the second pin through the second connection line; and the display panel further comprises a third wiring area located on one side of the first data line along an extending direction of the first data line, and the display panel further comprises a third connection line located in the third wiring area, and the third detection circuit being connected to the third pin through the third connection line.

12. The detection circuit according to claim 1, wherein a first electrode of the driving transistor is connected to a first power source terminal, and the pixel driving circuit further comprises: a capacitor coupled between the gate and the second electrode of the driving transistor.

13. The detection circuit according to claim 1, wherein one or more of the first detection circuits, the second detection circuits, and the third detection circuits are integrated in a display pixel area of the display panel.

14. A driving method of a detection circuit applied to a display panel, comprising:

providing the display panel, the display panel comprising a first pin group for connecting a first gate driving circuit, a second pin group for connecting a second gate driving circuit, a third pin group for connecting a source driving circuit, the first pin group comprising a plurality of first pins, the second pin group comprising a plurality of second pins, and the third pin group comprising a plurality of third pins, and the display panel further comprising a plurality of display sub-pixels, and a pixel driving circuit of each of the display sub-pixels comprising a switching transistor, a detection transistor, and a driving transistor, a second electrode of the switching transistor being connected to a gate of the driving transistor, a first electrode of the detection transistor being connected to a second electrode of the driving transistor, and the first gate driving circuit being configured to provide a gate driving signal to the switching transistor, the second gate driving circuit being configured to provide a gate driving signal to the detection transistor, and the source driving circuit being configured to provide a data signal to the gate of the driving transistor through the switching transistor, wherein gates of switching transistors located in a same pixel row are coupled through a first gate line, and gates of detection transistors located in a same pixel row are coupled through a second gate line, first electrodes of the switching transistors located in a same pixel column are coupled through a first data line, and second electrodes of the detection transistors located in a same pixel column are coupled through a sensing signal line, wherein the detection circuit comprises:

a plurality of first detection circuits, wherein the first detection circuits and first gate lines are disposed in a one-to-one correspondence, and each of the first detection circuits is connected to the first pin, a first control signal terminal, a first detection signal terminal and a first gate line corresponding to the first detection circuit, and each of the first detection circuits is configured to transmit a signal of the first pin to the first detection signal terminal in response to a control signal, and configured to transmit a signal of the first detection signal terminal to the first gate line in response to a signal of the first control signal terminal;

a plurality of second detection circuits, wherein the second detection circuits and second gate lines are disposed in a one-to-one correspondence, and each of the second detection circuits is connected to the second pin, a second control signal terminal, a second detection signal terminal and a second gate line corresponding to the second detection circuit, and each of the second detection circuits is configured to transmit a signal of the second pin to the second detection signal terminal in response to a control signal, and configured to transmit a signal of the second detection signal terminal to the second gate line in response to a signal of the second control signal terminal; and a plurality of third detection circuits, wherein the third detection circuits are disposed in a one-to-one correspondence with first data lines and sensing signal lines located in a same pixel column, and each of the third detection circuits is connected to a first data line corresponding to the third detection circuit, a sensing signal line corresponding to the third detection circuit, a third detection signal terminal and a third control signal terminal, and each of the third detection circuits is configured to transmit a signal of the third pin to the third detection signal terminal in response to a control signal, and configured to transmit a signal of the third detection signal terminal to the sensing signal line in response to a signal of the third control signal terminal, wherein the method comprises:

in a first detection stage, providing a switch-off signal to the first control signal terminal, and connecting the first pin and the first detection signal terminal in response to a control signal, so that a connecting state between the first pin group and the first gate driving circuit is detected through the first detection signal terminal;

providing a switch-off signal to the second control signal terminal, and connecting the second pin and the second detection signal terminal in response to a control signal, so that a connecting state between the second pin group and the second gate driving circuit is detected through the second detection signal terminal; and providing a switch-off signal to the third control signal terminal, and connecting the third pin and the third detection signal terminal in response to a control signal, so that a connecting state between the third pin group and the source driving circuit is detected through the third detection signal terminal; and in a second detection stage, providing a switch-on signal to the first control signal terminal, the second control signal terminal, and the third control signal terminal, and connecting the first pin and the first detection signal terminal in response to a control signal, connecting the second pin and the second detection signal terminal in response to a control signal, and connecting the third pin and the third detection signal terminal in response to a control signal, so that a driving state of the display sub-pixel is detected through the third detection signal terminal.

15. The driving method according to claim 14, wherein the detection circuit comprises a detection signal determination sub-circuit, and the driving method comprises:

determining a connecting state between the first pin group and the first gate driving circuit by the detection signal determination sub-circuit;

determining a connecting state between the second pin group and the second gate driving circuit by the detection signal determination sub-circuit; and determining the driving state of the display sub-pixel by the detection signal determination sub-circuit.

16. A display panel, comprising: a detection circuit; a first pin group for connecting a first gate driving circuit; a second pin group for connecting a second gate driving circuit; a third pin group for connecting a source driving circuit, wherein the first pin group comprising a plurality of first pins, the second pin group comprising a plurality of second pins, and the third pin group comprising a plurality of third pins, and the display panel further comprises a plurality of display sub-pixels, and a pixel driving circuit of each of the display sub-pixels comprising a switching transistor, a detection transistor, and a driving transistor, a second electrode of the switching transistor being connected to a gate of the driving transistor, a first electrode of the detection transistor being connected to a second electrode of the driving transistor, and the first gate driving circuit being configured to provide a gate driving signal to the switching transistor, the second gate driving circuit being configured to provide a gate driving signal to the detection transistor, and the source driving circuit being configured to provide a data signal to the gate of the driving transistor through the switching transistor, wherein gates of switching transistors located in a same pixel row are coupled through a first gate line, and gates of detection transistors located in a same pixel row are coupled through a second gate line, first electrodes of the switching transistors located in a same pixel column are coupled through a first data line, and second electrodes of the detection transistors located in a same pixel column are coupled through a sensing signal line, wherein the detection circuit comprises:

a plurality of first detection circuits, wherein the first detection circuits and first gate lines are disposed in a one-to-one correspondence, and each of the first detection circuits is connected to the first pin, a first control signal terminal, a first detection signal terminal and a first gate line corresponding to the first detection circuit, and each of the first detection circuits is configured to transmit a signal of the first pin to the first detection signal terminal in response to a control signal, and configured to transmit a signal of the first detection signal terminal to the first gate line in response to a signal of the first control signal terminal;

a plurality of second detection circuits, wherein the second detection circuits and second gate lines are disposed in a one-to-one correspondence, and each of the second detection circuits is connected to the second pin, a second control signal terminal, a second detection signal terminal and a second gate line corresponding to the second detection circuit, and each of the second detection circuits is configured to transmit a signal of the second pin to the second detection signal terminal in response to a control signal, and configured to transmit a signal of the second detection signal terminal to the second gate line in response to a signal of the second control signal terminal; and a plurality of third detection circuits, wherein the third detection circuits are disposed in a one-to-one correspondence with first data lines and sensing signal lines located in a same pixel column, and each of the third detection circuits is connected to a first data line corresponding to the third detection circuit, a sensing signal line corresponding to the third detection circuit, a third detection signal terminal and a third control signal terminal, and each of the third detection circuits is configured to transmit a signal of the third pin to the third detection signal terminal in response to a control signal, and configured to transmit a signal of the third detection signal terminal to the sensing signal line in response to a signal of the third control signal terminal.

17. The display panel according to claim 16, wherein the first detection circuit comprises:

a first transistor, wherein a first electrode of the first transistor is connected to the first pin, a second electrode of the first transistor is connected to the first detection signal terminal, and a gate of the first transistor is connected to the first pin; and a second transistor, wherein a first electrode of the second transistor is connected to the first detection signal terminal, a second electrode of the second transistor is connected to the first gate line, and a gate of the second transistor is connected to the first control signal terminal.

18. The display panel according to claim 16, wherein the second detection circuit comprises:

a third transistor, wherein a first electrode of the third transistor is connected to the second pin, a second electrode of the third transistor is connected to the second detection signal terminal, and a gate of the third transistor is connected to the second pin; and a fourth transistor, wherein a first electrode of the fourth transistor is connected to the second detection signal terminal, a second electrode of the fourth transistor is connected to the second gate line, and a gate of the fourth transistor is connected to the second control signal terminal.

19. The display panel according to claim 16, wherein the third detection circuit is configured to transmit the signal of the third pin to the third detection signal in response to a signal of the first data line, and wherein the third detection circuit comprises:

a fifth transistor, wherein a first electrode of the fifth transistor is connected to the third pin, a second electrode of the fifth transistor is connected to the third detection signal terminal, and a gate of the fifth transistor is connected to the first data line; and a sixth transistor, wherein a first electrode of the sixth transistor is connected to the sensing signal line, a second electrode of the sixth transistor is connected to the third detection signal terminal, and a gate of the sixth transistor is connected to the third control signal terminal.

20. The display panel according to claim 16, wherein the third detection circuit is configured to transmit the signal of the third pin to the third detection signal terminal in response to a signal of a fourth control signal terminal, and wherein the third detection circuit comprises:

a fifth transistor, wherein a first electrode of the fifth transistor is connected to the third pin, a second electrode of the fifth transistor is connected to the third detection signal terminal, and a gate of the fifth transistor is connected to the fourth control signal terminal; and a sixth transistor, wherein a first electrode of the sixth transistor is connected to the sensing signal line, a second electrode of the sixth transistor is connected to the third detection signal terminal, and a gate of the sixth transistor is connected to the third control signal terminal.

* * * * *